US011515647B2

(12) United States Patent
Noah et al.

(10) Patent No.: US 11,515,647 B2
(45) **Date of Patent: *Nov. 29, 2022**

(54) MULTIPLE LAYER PRINTED CIRCUIT BOARD THAT INCLUDES MULTIPLE ANTENNAS AND SUPPORTS SATELLITE COMMUNICATIONS

(71) Applicant: Skylo Technologies, Inc., Palo Alto, CA (US)

(72) Inventors: Moshe Noah, Sunnyvale, CA (US); Moshe Meir, Mazkerat Batia (IL)

(73) Assignee: Stylo Technologies, Inc., Palo Alto, CA (US)

( * ) Notice: Subject to any disclaimer, the term of this patent is extended or adjusted under 35 U.S.C. 154(b) by 37 days.

This patent is subject to a terminal disclaimer.

(21) Appl. No.: 17/346,251

(22) Filed: Jun. 13, 2021

(65) Prior Publication Data

US 2021/0313704 A1 Oct. 7, 2021

Related U.S. Application Data

(63) Continuation of application No. 16/840,338, filed on Apr. 4, 2020, now Pat. No. 11,069,985.

(51) Int. Cl.

| | |
|---|---|
| ***H01Q 21/06*** | (2006.01) |
| ***H01Q 3/36*** | (2006.01) |
| ***H01Q 1/28*** | (2006.01) |

(52) U.S. Cl.

CPC ..... *H01Q 21/061* (2013.01); *H01Q 1/288* (2013.01); *H01Q 3/36* (2013.01)

(58) Field of Classification Search

CPC .... H01Q 21/06; H01Q 21/061; H01Q 21/065; H01Q 1/288; H01Q 1/36; H01Q 1/38; H01Q 3/26; H01Q 3/36

See application file for complete search history.

(56) References Cited

U.S. PATENT DOCUMENTS

| | | | | |
|---|---|---|---|---|
| 5,608,414 | A * | 3/1997 | Amore | H01Q 1/02 343/770 |
| 6,239,762 | B1 * | 5/2001 | Lier | H01Q 21/24 343/846 |
| 6,356,166 | B1 * | 3/2002 | Goldsmith | H05K 1/0251 342/368 |
| 9,755,306 | B1 * | 9/2017 | Ogilvie | H01Q 3/40 |
| 11,069,985 | B1 * | 7/2021 | Noah | H01Q 1/288 |

(Continued)

*Primary Examiner* — Jason Crawford

(74) *Attorney, Agent, or Firm* — Brian R. Short

(57) ABSTRACT

Apparatuses, methods, and systems for a printed circuit board that includes multiple antennas, and operates to support satellite communications, are disclosed. One apparatus includes a first flat panel element. The first flat panel element includes a multilayer PCB (printed circuit board). The multilayer PCB includes a first exterior layer comprising N antenna elements, and a second exterior layer comprising N RF (radio frequency) chains operative to process the RF signals, each of the N RF chains electrically connected to a one of the N antenna elements, and N metal patches arranged in a square, wherein an air gap is located between the N metal patches and the N antenna elements, wherein dimensions, orientation, and spacing between the N metal patches and the N antenna elements are selected based on a carrier frequency, bandwidth, and directionality of the propagated RF signals.

20 Claims, 10 Drawing Sheets

(56) References Cited

U.S. PATENT DOCUMENTS

| | | | | |
|---|---|---|---|---|
| 11,342,665 | B1 * | 5/2022 | Reuveni | H01Q 1/2283 |
| 2004/0145528 | A1 * | 7/2004 | Mukai | H01Q 1/243<br>343/702 |
| 2009/0251362 | A1 * | 10/2009 | Margomenos | G01S 13/931<br>342/175 |
| 2010/0066631 | A1 * | 3/2010 | Puzella | H01Q 21/065<br>29/601 |
| 2019/0356057 | A1 * | 11/2019 | Carey | H01Q 21/065 |
| 2021/0313704 | A1 * | 10/2021 | Noah | H01Q 21/061 |

* cited by examiner

MULTIPLE LAYER PRINTED CIRCUIT BOARD THAT INCLUDES MULTIPLE ANTENNAS AND SUPPORTS SATELLITE COMMUNICATIONS

RELATED PATENT APPLICATIONS

This patent application is a continuation of U.S. patent Ser. No. 16/840,338, filed Apr. 4, 2020, which is herein incorporated by reference.

FIELD OF THE DESCRIBED EMBODIMENTS

The described embodiments relate generally to satellite communications. More particularly, the described embodiments relate to systems, methods and apparatuses for a multiple layer printed circuit board that includes multiple antennas, and operates to support satellite communications.

BACKGROUND

Current data networks are designed primarily for human users and the network and traffic characteristics that human users generate. The growth and proliferation of low-cost embedded wireless sensors and devices pose a new challenge of high volumes of low bandwidth devices vying for access to limited network resources. One of the primary challenges with these new traffic characteristics is the efficiency at which the shared network resources can be used. For common low bandwidth applications such a GPS tracking, the efficiency (useful/useless data ratio) can often be below 10%. This inefficiency is the result of large volumes of devices communicating in an uncoordinated environment. Addressing this problem is fundamental to the future commercial viability of large-scale sensor network deployments.

It is desirable to have methods, apparatuses, and systems for a multiple layer printed circuit board that includes multiple antennas, and operates to support satellite communications.

SUMMARY

An embodiment includes an apparatus. The apparatus includes a first flat panel element. The first flat panel element includes a multilayer PCB (printed circuit board), wherein the multilayer PCB includes more than two layers. The multilayer PCB includes a first exterior layer comprising N antenna elements, wherein each of the N antenna elements operate to enable propagation of RF (radio frequency) signals, and a second exterior layer of the of the PCB comprising N RF (radio frequency) chains operative to process the RF signals, each of the N RF chains electrically connected to a one of the N antenna elements, N metal patches arranged in a square, wherein an air gap is located between the N metal patches and the N antenna elements, wherein dimensions, orientation, and spacing between the N metal patches and the N antenna elements are selected based on a carrier frequency, bandwidth, and directionality of the propagated RF signals.

Another embodiment includes a method. The method includes enabling propagation, by N antenna elements of a first exterior layer of a multilayer PCB, RF (radio frequency) signals, wherein the multilayer PCB includes more than two layers, and processing, by N RF (radio frequency) chains of a second exterior layer of the multilayer PCB, the RF signals, wherein each of the N RF chains is electrically connected to a one of the N antenna elements, enabling, by N metal patches, communication with a satellite, wherein the N metal patches are arranged in a square, wherein an air gap is located between the N metal patches and the N antenna elements, wherein dimensions, orientation, and spacing between the N metal patches and the N antenna elements are selected based on a carrier frequency, bandwidth, and directionality of the propagated RF signals.

Other aspects and advantages of the described embodiments will become apparent from the following detailed description, taken in conjunction with the accompanying drawings, illustrating by way of example the principles of the described embodiments.

DETAILED DESCRIPTION

The embodiments described include methods, apparatuses, and systems for a multiple layer printed circuit board that includes multiple antennas, and operates to support satellite communications.

Figure 1:
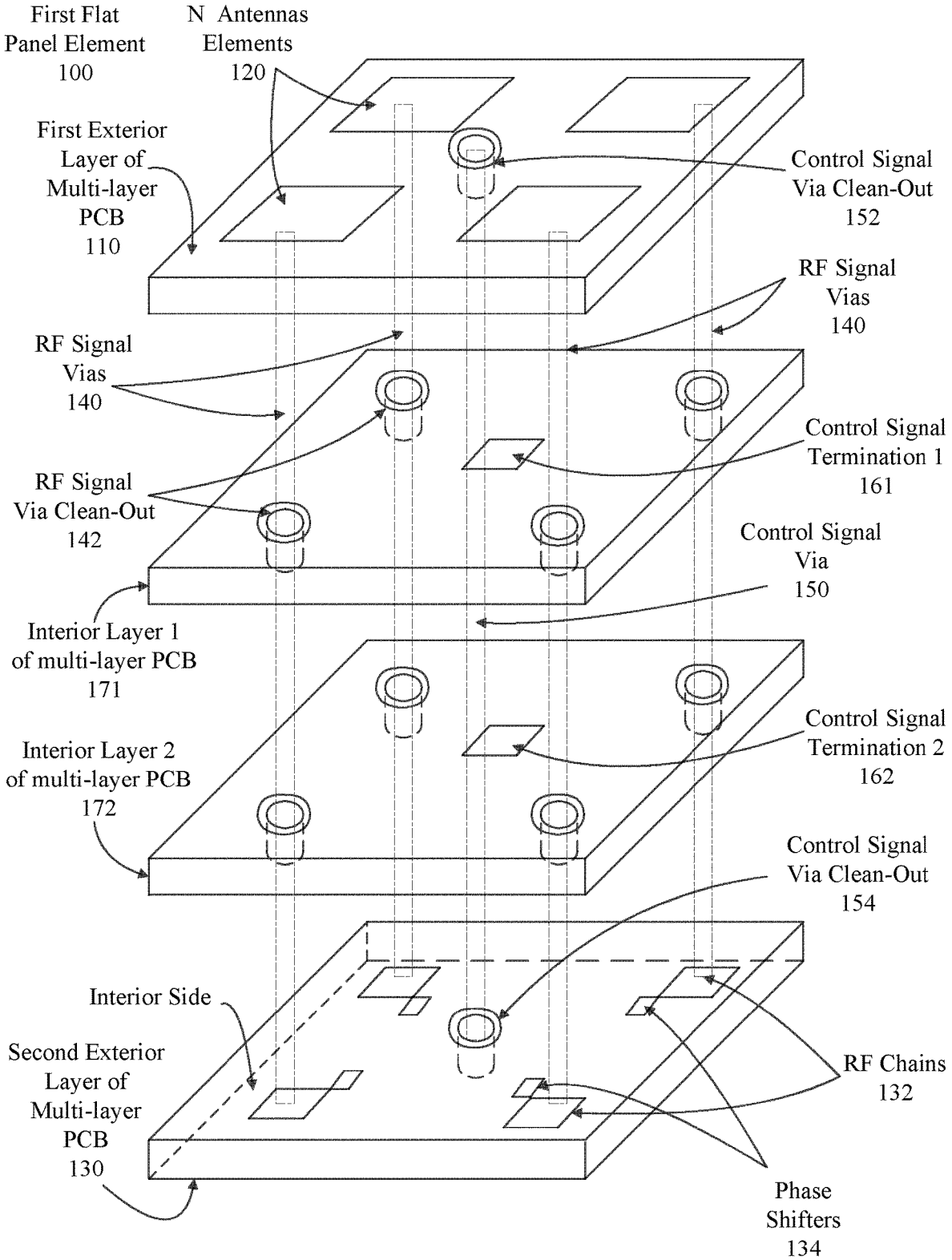
FIG. 1 shows a multiple layer printed circuit board that includes multiple antenna elements, and operates to support satellite communications, according to an embodiment.

FIG. 1 shows a multiple layer printed circuit board that includes multiple antenna elements 120, and operates to support satellite communications, according to an embodiment. First flat panel element 100 includes the multiple layer PCB (printed circuit board). For an embodiment, the multiple layer PCB includes more than two layers, including, for example, a first exterior layer 110, a second exterior layer 130, an interior layer 1 171 and an interior layer 2 172.

For an embodiment, the first exterior layer 110 includes N antenna elements 120, wherein each of the N antenna elements 120 operate to enable propagation of RF (radio frequency) signals. For an embodiment, the N antenna elements 120 operate as radiating elements to enable the propagation of the RF signals. For an embodiment, the N antenna elements 120 couple RF (radio frequency) signals to N metal patches (not shown in FIG. 1), and the N metal patches and the N antenna elements in combination operate as radiating elements to enable the propagation of the RF signals.

For an embodiment, the second exterior layer 130 includes N RF (radio frequency) chains 132 operative to process the RF signals. For an embodiment, each of the N RF chains 132 is electrically connected to a one of the N antenna elements 120 through RF signal vias 140. For an embodiment, each of the RF chains 132 includes phase shifters (delay lines) 134. For an embodiment, each phase shifter 134 includes a plurality of PCB length routes that are selectable with a switch, wherein settings of the switch are determined by control signals. The RF chains 132 further include RF transmission and reception processing circuitry, such as, amplifiers and frequency converters.

For an embodiment, all of a plurality of plated through hole vias of the PCB (that is, both the RF signal control vias 140 and the control signal vias (such as, control signal via 150)) extend through the multilayer PCB from the first exterior layer 110 to the second exterior layer 130, wherein vias (such as, via 150) that operate to connect control signals include extended cleanouts (shown in FIG. 1 as control signal via clean-outs 152, 154) on layers (shown on the first exterior layer 110 and the second exterior layer 130) of the multilayer PCB that do not include terminations of the control signals.

As described, the multilayer PCB includes both the RF signal vias 140, and the control signal vias 150. For clarity of illustration, only one control signal via 150 is shown in FIG. 1. However, the multilayer PCB typically includes many control signal vias not illustrated. As described, for an embodiment all of the RF signal vias extend from the first exterior layer 110 and the second exterior layer 130 and electrically connect RF signal circuitry of, for example, the second exterior 130 to the N antenna elements 120 of the first exterior layer 110. RF signal via clean-outs 142 are located at the locations in which each of the RF signal vias 140 pass through the interior layers 171, 172. That is, none of the RF signal vias 140 are electrically connected to anything on the interior layers 171, 172, and the RF signal via clean-outs 142 includes insulating barriers (a lack of conductor) between the RF signal vias 140 and anything located on the interior layers 171, 172. Further, all of the control signal vias (such as, control signal via 150) also extend from the first exterior layer 110 and the second exterior layer 130, but include control signal via clean-outs 152 on the layers of the PCB that the control signal vias are not electrically connected to a termination of the control signals of the control signal vias. For example, the control signal via 150 may be electrically connected to a control signal termination 161 of the interior layer 171, and electrically connected to a control signal termination 162 of the interior layer 172. However, because the first exterior layer 110 and the second exterior layer 130 do not include a termination of the control signals of the control signal via 150, the first exterior layer 110 and the second exterior layer 130 include the control signal via clean-outs 152, 154. It should be noted that the second exterior layer 130 includes the phase shifter 134 that includes a plurality of PCB length routes that are selectable with a switch, wherein settings of the switch are determined by control signals. Accordingly, at least some of the control signal vias do terminate on the second exterior layer 130. For at least some embodiments, none of the control signal vias terminate on the first exterior layer 110, but extend to the first exterior layer 110 and include a control signal via clean-out on the first exterior layer 110.

Figure 2:
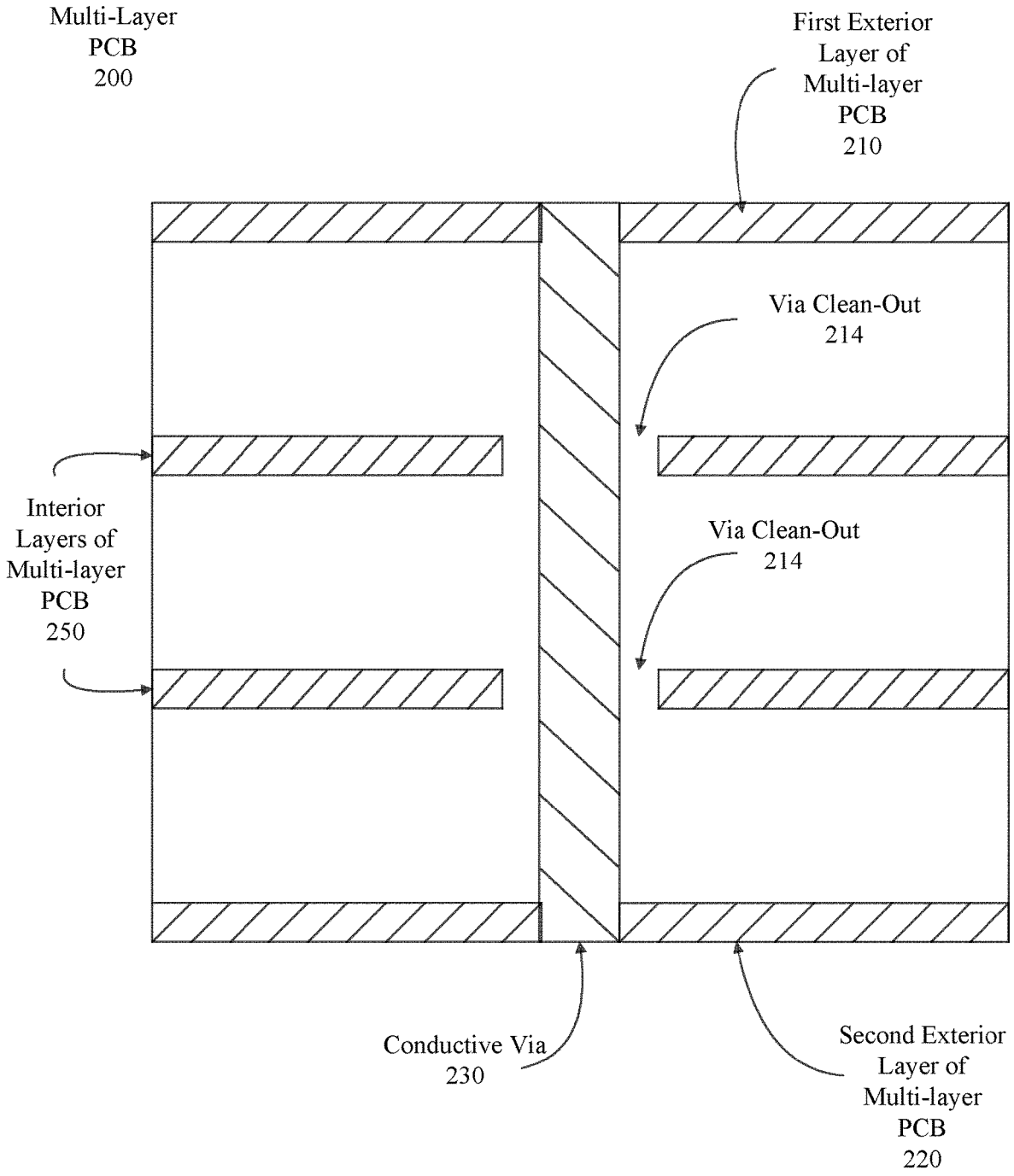
FIG. 2 shows a conductive via of a multiple layer printed circuit board that includes via clean-outs, according to an embodiment.

FIG. 2 shows a plated through hole via 230 of a multiple layer PCB (printed circuit board) 200 that includes via clean-outs 214, according to an embodiment. The plated through hole via 230 electrically connects the first exterior layer 210 of the multi-layer PCB to the second exterior layer 220 of the of the multi-layer PCB. As shown, the exterior layer 210, 220 are exterior to the multi-layer PCB as opposed to the interior layers which are not exposed. As previously described, the first exterior layer 210 includes the multiple antenna elements, and the second exterior 220 layer includes the RF chains and associated phase delay circuitry.

The plated through hole via 230 of FIG. 2 does not electrically connect to the interior layers 250 of the multi-layer PCB. Accordingly, the via clean-outs 214 are located where the plated through hole via 230 passes through the interior layers 250. For an embodiment, the plated through hole via 230 must include RF signals because the plated through hole via 230 electrically connects the first exterior layer 210 to the second exterior layer 220. That is, for an embodiment, the control signal vias always extend to the first exterior layer 210, and always include a via clean-out 214 on the first exterior layer 210. However, the control signal vias may be electrically connected to the second exterior layer 220 for controlling the phase delay.

Figure 3:
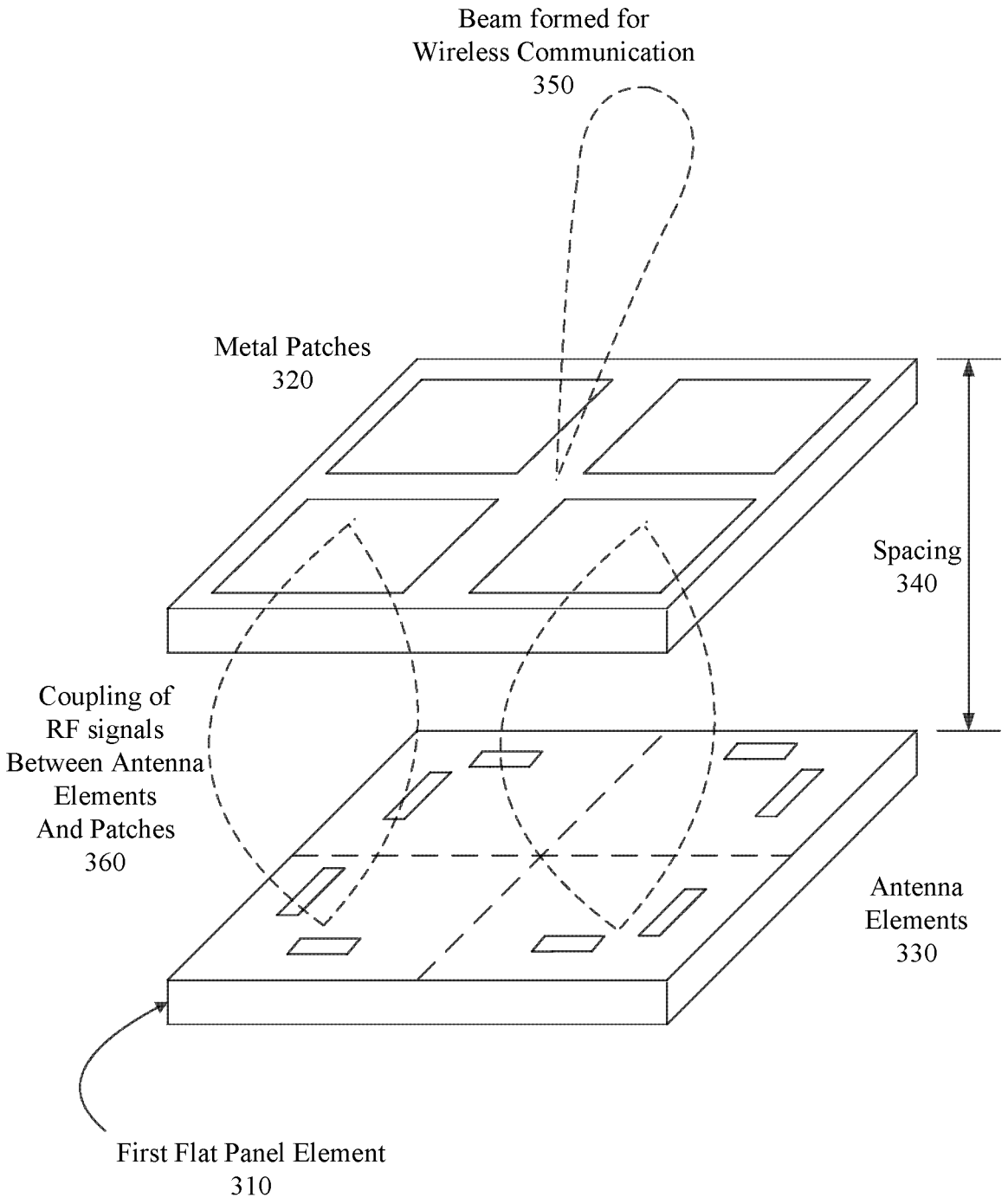
FIG. 3 shows a first flat panel element that includes antenna elements that couple with metal patches to form a beam to facilitate wireless communication, according to an embodiment.

FIG. 3 shows a first flat panel element 310 that includes antenna elements 330 that couple RF signals 360 with (that is, to and from) metal patches 320 to form a beam 350 to facilitate wireless communication, according to an embodiment. For an embodiment, the first flat panel element 310 includes the previously described multiple layer PCB. As described, the first exterior layer of the PCB includes the antenna elements 330.

FIG. 3 further includes the N metal 320 patches arranged in a square, wherein an air gap (shown as spacing 340) is located between the N metal patches 320 and the N antenna elements 330, wherein dimensions, orientation, and spacing (relative spacing between N metal patches 320 and the air gap) between the N metal patches 320 and the N antenna elements 330 are selected based on a carrier frequency, bandwidth, and directionality of the propagated RF signals. FIG. 3 further includes the N metal 320 patches arranged in a square, wherein an air gap (shown as spacing 340) is located between the N metal patches 320 and the N antenna elements 330, wherein dimensions, orientation, and spacing between the N metal patches 320 and the N antenna elements 330 are selected based on a carrier frequency, bandwidth, and directionality of the propagated RF signals.

Through simulation and/or experimentation, the dimensions, orientation, and spacing between the N metal patches 320 and the N antenna elements 330 are selected to achieve or provide a desired signal quality wireless link between the antenna elements 330 and one or more satellites (not shown). For at least some embodiments, the spacing 340 of the air gap is selected (through simulation and/or experimentation) as part of the antenna design according to the desired carrier frequencies, bandwidth, and cross-polarization. For an embodiment, the N metal patches 320 operate as radiating elements, and a relative position between the N antenna elements 330 and the N metal patches 320 determines which radiating modes of the radiating elements are excited. RF signals are coupled (360) between the antenna elements 330 and the metal patches 320 to facilitate the communication of the RF signals through a satellite link formed between the metal patches 320 and the one or more satellites.

For an embodiment, a second flat panel element includes the N metal patches 320, wherein an air gap is located between the first flat panel element 310 and the second flat panel element, wherein dimensions, orientation, and spacing between the first flat panel element 310 and the second flat panel element are selected based on a carrier frequency, bandwidth, and directionality of the propagated RF signals. It is to be understood that the "air" within the air gap is a dielectric. For at least some embodiments, FR4 (PCB), or Rogers are potential dielectric replacements for the air gap.

Figure 4:
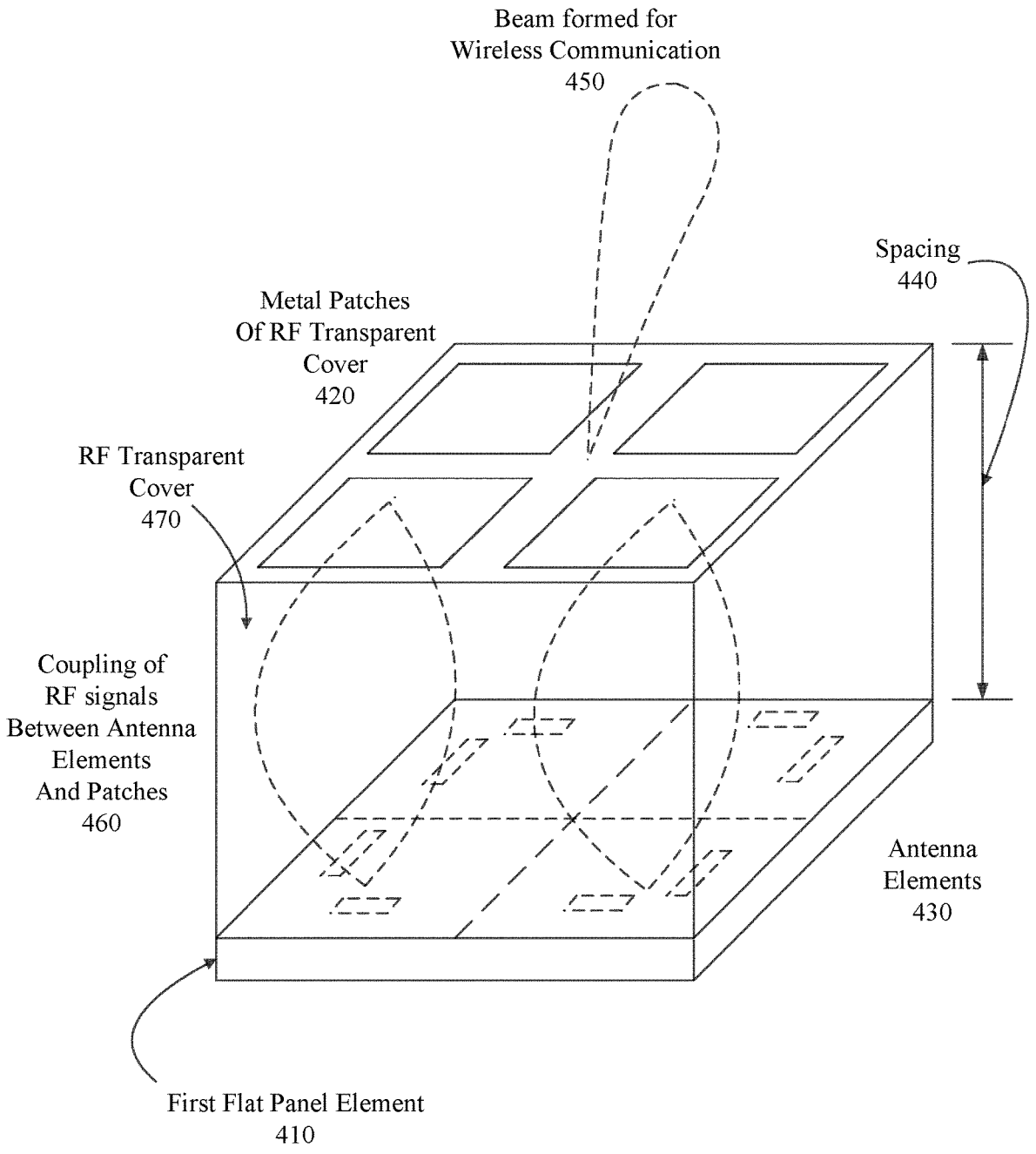
FIG. 4 shows a first flat panel element that includes antenna elements that couple with metal patches of an RF transparent cover to form a beam to facilitate wireless communication, according to an embodiment.

FIG. 4 shows a first flat panel element 410 that includes antenna elements 430 that couple (460) RF signals with metal patches 420 of an RF transparent cover 470 to form a beam to facilitate wireless communication, according to an embodiment. For an embodiment, the first flat panel element 410 in combination with the RF transparent cover 470 form a single unit that may be connected to an external device. The single unit is robust and electronics associated with the first flat panel element are contained within the single unit keeping them safe from the environment. The metal patches 420 can be formed on an internal surface of the RF transparent cover 470 as RF signals can propagate through the RF transparent cover 470. As previously described, the N metal patches 320 operate as radiating elements, and a relative position between the N antenna elements 330 and the N metal patches 320 determines which radiating modes of the radiating elements are excited. Further, as previously described, RF signals are coupled (460) between the antenna elements 430 and the metal patches 420 to facilitate the communication of the RF signals through a satellite link formed between the metal patches 420 and the one or more satellites.

Figure 5:
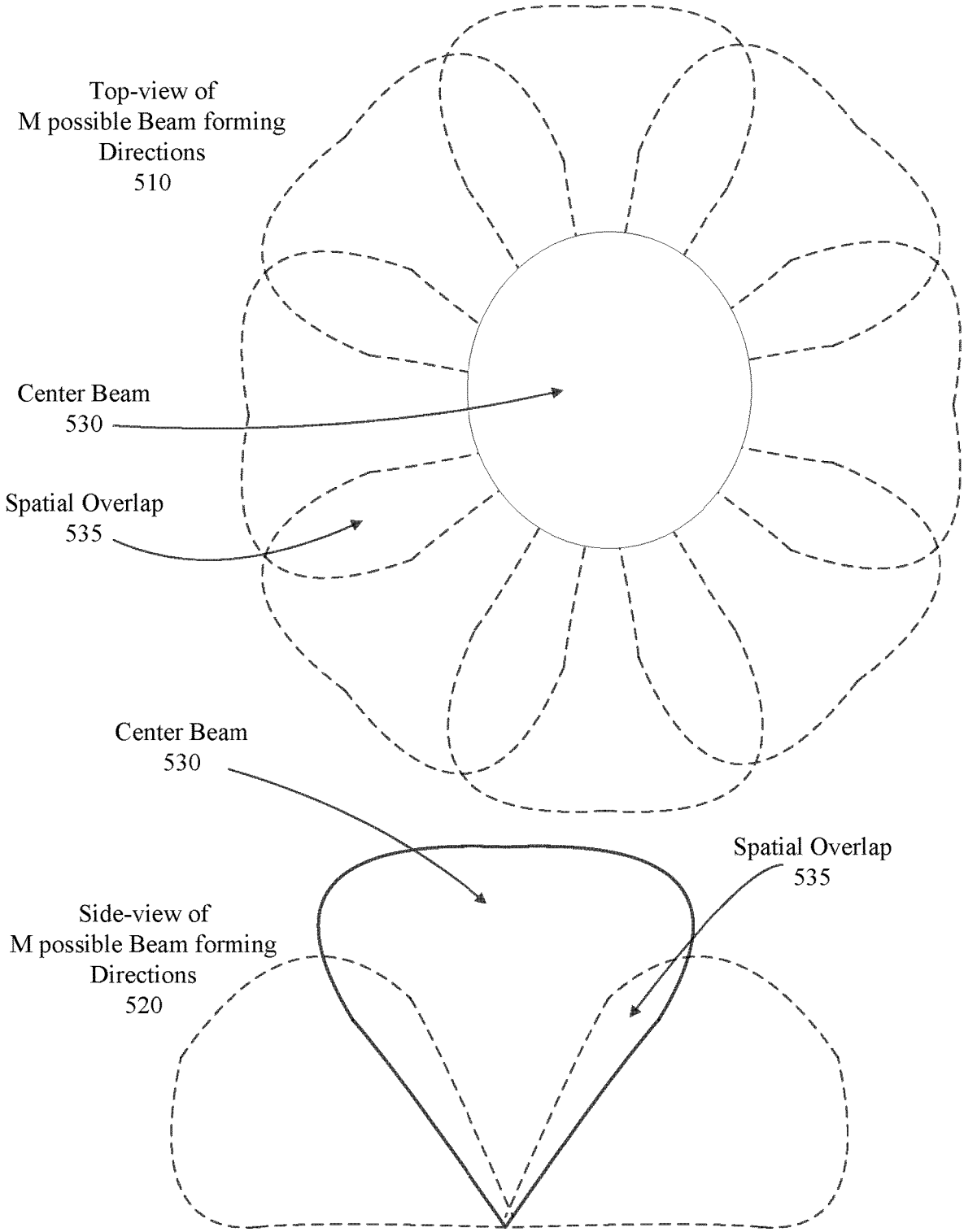
FIG. 5 shows M possible beamforming directions of the multiple antennas of the multiple layer printed circuit board, according to an embodiment.

FIG. 5 shows M possible beamforming directions 510 of the multiple antennas of the multiple layer printed circuit board, according to an embodiment. For an embodiment, the multiple layer PCB or a package that includes the multiple layer PCB is attached to a mobile device. Accordingly, the physical orientation of the multiple layer PCB can constantly and rapidly change. In order for the multiple antennas of the multiple layer PCB to maintain a wireless link of a desired signal quality with a satellite, a direction of a beam formed by the multiple antennas needs to be able to adaptively update, modify, or change an orientation of the beam formed by the multiple antennas. For at least some embodiments, the directional beamforming is achieved by the previously described control signals manipulating the previously described switches (associated with the phase shifters) to route RF signals down varying length traces to produce phase shifts in RF signals coupled to the N antenna elements.

For an embodiment, the M beam directions form a half-spherical set of possible beam directions. FIG. 5 shows 9 possible beam directions, but any number of beam directions can be used. Each of the different beams provides a different beamforming direction. For an embodiment, the different beamforming directions are determined by phase shifters associated with the RF chains. As shown, the top-view of the M beam directions includes a center beam 530. Further, FIG. 5 shows a side-view of the M possible beam forming directions 520 including the center beam 530.

For an embodiment, the N antenna elements operate to form a pseudo-directional beam. For an embodiment, the pseudo-directional beam is selectable to be directed to at least one of M possible directions as determined by the phase shifters of the RF chains, wherein the M possible directions cover a half spherical combination of beam directions. Further, a spatial overlap 535 between the pseudo-directional beam of the M possible directions are selected to provide maintenance of a wireless link between the apparatus and a base station through a satellite while the apparatus is subjected to motion having a slew rate of the motion of at least a threshold.

For an embodiment, the N antenna elements that operate to form the M possible beams is associated with a processing unit and an IMU (internal measurement unit that includes, for example, an accelerometer, a gyroscope, and an optional magnetometer) and a GPS (global positioning system) receiver. For an embodiment, the IMU determines an absolute orientation of the antenna elements (or a device the antenna elements are attached to), and based upon the location of the radiating (transmitting) elements (for example, a user device antenna that includes the antenna elements) and receiving (for example, an uplink satellite) elements informs the processing unit how to control the switches to form/select the maximal gain/direction beam of the antenna elements. That is, the processing unit or controller associated with the antenna elements selects the operational beam formed (for example, a one of the M (9) possible beam directions) by the antenna elements based on the sensed orientation of the antenna elements, a location of the antenna elements, and a location of the satellite the antenna elements are facilitating wireless communication.

For an embodiment the antenna elements are associated with a processing unit and an RSSI (receive signal strength indicator) sensor, which the processing unit scans (via the control signals) through the 9 different beam configurations and selects the beam with the highest RSSI. For an embodiment, the best (selected) beam direction provides the greatest receive signal strength.

Figure 6:
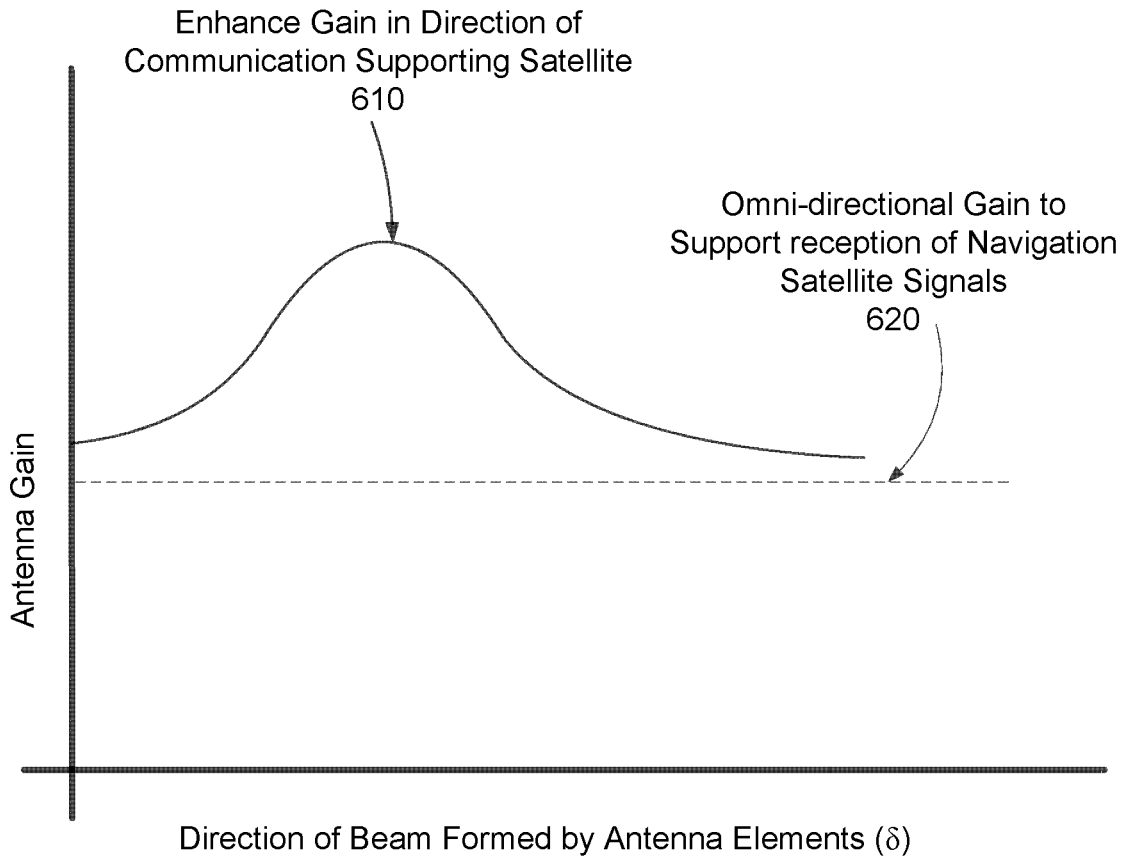
FIG. 6 is a curve that shows antenna gain of each of the M possible beamforming directions relative direction, according to an embodiment.

FIG. 6 is a curve 610 that shows antenna gain of each of the M possible beamforming directions relative to direction, according to an embodiment. That is, the curve 610 represents the antenna gain versus direction from the apparatus that includes the N antenna elements. As stated, the curve represents the antenna gain for each of the M possible beams. As shown, for an embodiment, the N antenna elements operate to enable formation of a pseudo-directional beam. That is, each beam is designed to have an enhanced gain in a specific direction similar to a direction antenna, but still have enough omni-directional gain to maintain at least an acceptable level of omni-directional gain in all other directions. The curve 610 shows the enhanced level of antenna gain in a specific direction while still maintaining at least a specified omni-directional gain 620 to support, for example, reception of wireless signals from navigational satellites. For an embodiment, a collecting area of the antenna formed by the antenna elements is large enough to have the desired gain.

Figure 7:
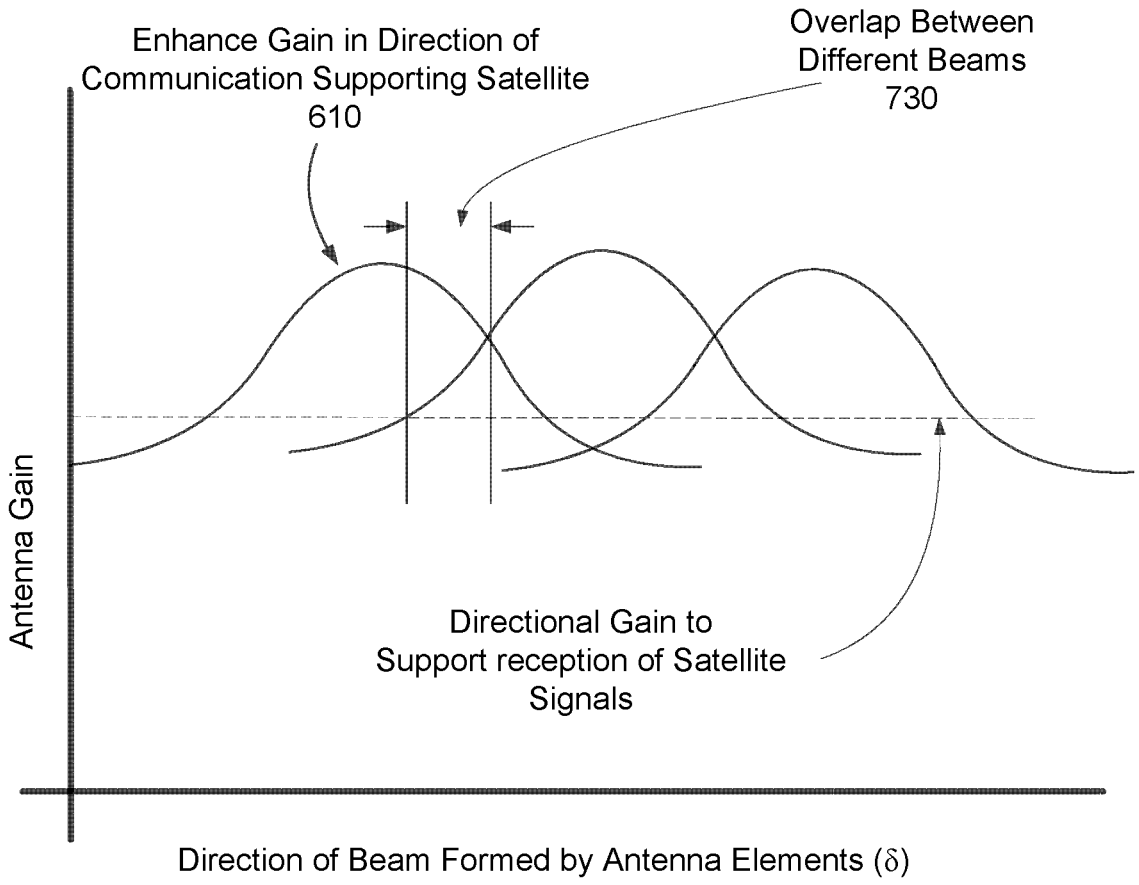
FIG. 7 show curves of antenna gains of multiple of the M possible beam forming directions, and shows an overlap between the gains of the multiple beam forming directions relative to direction, according to an embodiment.

FIG. 7 show curves of antenna gains of multiple of the M possible beam forming directions, and shows an overlap 730 between the gains of the multiple beam forming directions relative to direction, according to an embodiment. As previously stated, for an embodiment, the pseudo-directional beam is selectable to be directed to at least one of M possible directions as determined by the phase shifters of the RF chains, wherein the M possible directions cover a half spherical combination of beam directions. Further, as previously stated, for an embodiment, the spatial overlap 730 between the pseudo-directional beam of the M possible directions is selected to provide maintenance of a wireless link between the apparatus and a base station through a satellite while the apparatus (that is, the N antenna elements) is subjected to motion having a slew rate of the motion of at least a threshold. That is, as a device (attached, for example, to the apparatus) associated (for example, connected to) changes its orientation, different pseudo-omnidirectional directions need to be selected. Further, between selections, a desired level of antenna gain needs to be maintained. This is enabled by selecting the omni-directional beams such that neighboring omni-directional beams have an overlap to ensure a desired level of antenna gain between the switching of one omni-directional beam to another. For an embodiment, a subset of the M possible directions is activated at a time.

For at least some embodiments, the pseudo-directional beam is selected to include enough directional gain to enhance transmission from the apparatus through a wireless satellite link to a base station over a first carrier frequency. That is, the communication between the apparatus and the satellite includes a first carrier frequency, and the design (orientation, size, relative orientation) of the N antenna elements and/or the N conductive patches is selected to allow generation of the pseudo-directional beam that facilitates a wireless link between the apparatus and the satellite of at least a desired or required wireless link quality.

For at least some embodiments, the pseudo-directional beam is selected to include enough omni-directional gain to support reception through a plurality of wireless satellite links over at least a second carrier frequency. That is, for an embodiment, the carrier frequencies of wireless navigational satellite communication (for example, reception of GPS (global positioning system) signals) are different than the first carrier frequencies. Accordingly, in order for the apparatus to support both communication through the communication satellite and reception of the navigation satellite signals, the design (orientation, size, relative orientation) of the N antenna elements and/or the N conductive patches is selected to allow generation of the pseudo-directional beam that facilitates a wireless link between the apparatus and the satellite of at least a desired or required wireless link quality, and reception of the navigation satellite wireless signals of at least a desired or required wireless link quality.

For at least some embodiments, the directional gain of the pseudo-directional beam is selected to be greater at a direction of a communication supporting satellite link than for other directions. For at least some embodiments, the omni-directional gain of the pseudo-directional beam is selected to be greater than a threshold for a plurality of directions corresponding to directions of satellites of one or more navigational systems.

Figure 8:
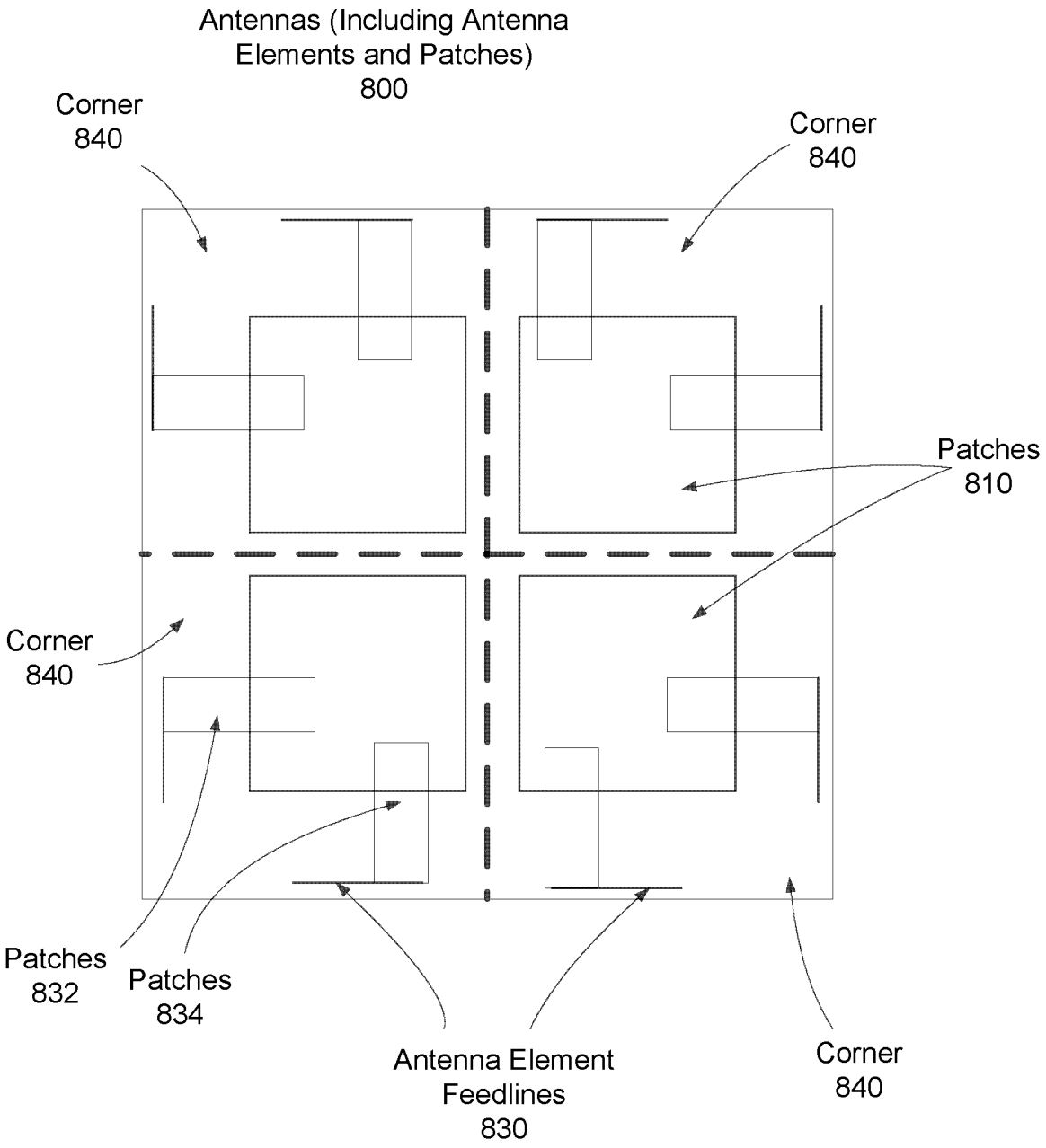
FIG. 8 shows multiple antenna elements that includes first and second element patches and corresponding metal patches, according to an embodiment.

FIG. 8 shows multiple antenna elements that includes first and second element patches 832, 834 and corresponding metal patches 810, according to an embodiment. For an embodiment, the N antenna elements each include the pair of rectangular element patches 832, 834, wherein a first element patch 832 is rotated approximately 90 degrees relative to a second element patch 834, and wherein each of the pairs of rectangular patches occupy a separate corner 840 of the first exterior layer of the multilayer PCB. Further, each of the element patches 832, 834 include antenna element feedlines 836. As previously described, for an embodiment, the metal patches 810 are located so that a spacing (for example, the air gap) exists between the metal patches 810 and the element patches 832, 834.

As previously described, for an embodiment, associated with each one of the antenna elements are RF active elements (such as, power amplifiers, low noise amplifiers, the previously described switches for controlling phase shift). The RF active elements are connected with transmission lines and the plated through hole vias to the antenna element feedlines 836 of each of the antenna elements.

For an embodiment, four antenna elements form an antenna array. For at least some embodiments, the distance between each of the antenna elements is designed in such a way to create the most effective bandwidth to cover transmit and receive frequency with the same elements. As described, for an embodiment, each antenna element includes the element patches 832, 834 that operate to generate a circular polarization radiation pattern.

Figure 9:
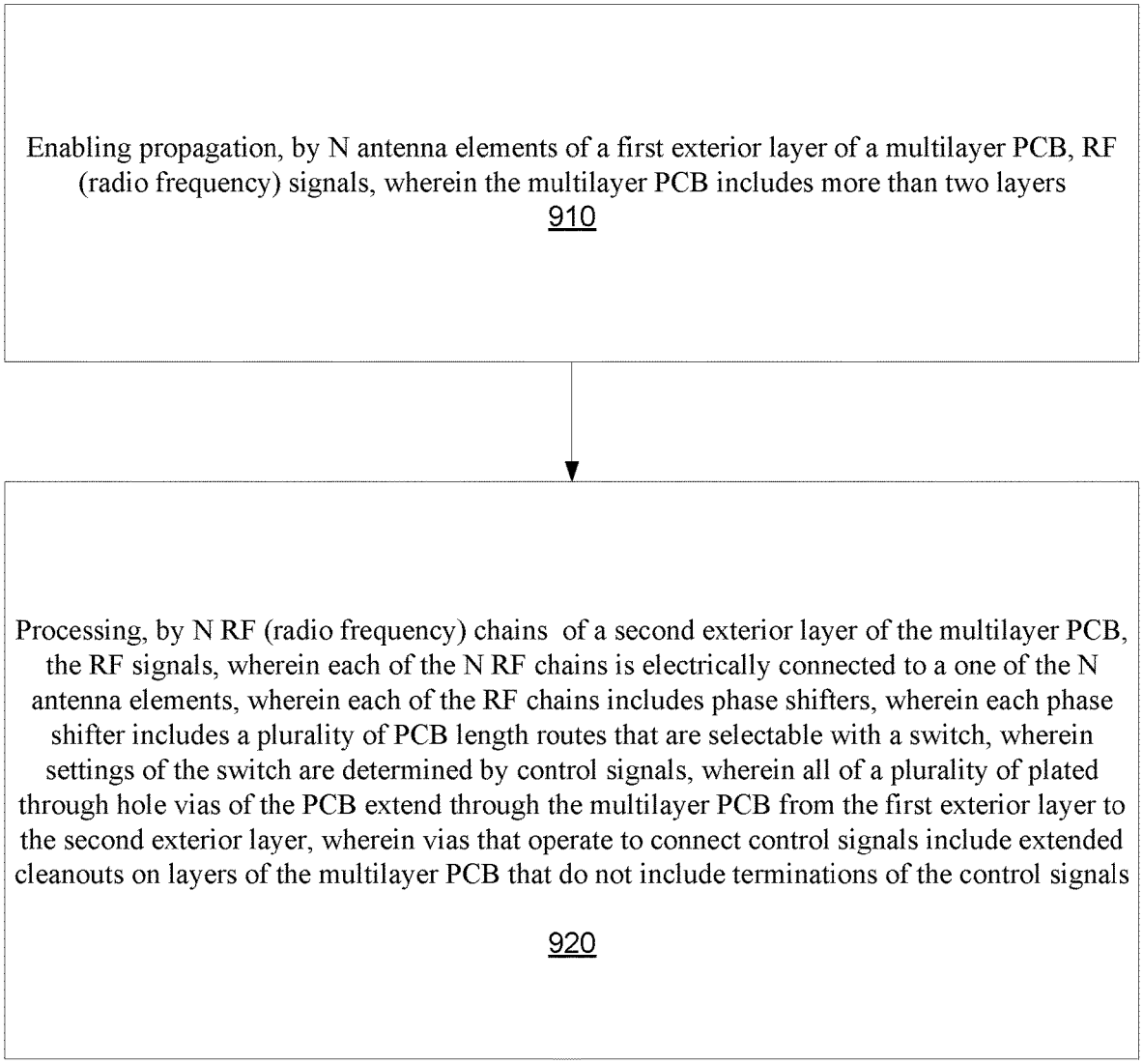
FIG. 9 is a flow chart that include steps of a method enabling propagation of RF (radio frequency) signals by a multiple layer printed circuit board, according to an embodiment.

FIG. 9 is a flow chart that includes steps of a method enabling propagation of RF (radio frequency) signals by a multiple layer printed circuit board, according to an embodiment. A first step 910 enabling propagation, by N antenna elements of a first exterior layer of a multilayer PCB, RF (radio frequency) signals, wherein the multilayer PCB includes more than two layers. A second step 920 includes processing, by N RF (radio frequency) chains of a second exterior layer of the multilayer PCB, the RF signals, wherein each of the N RF chains is electrically connected to a one of the N antenna elements, wherein each of the RF chains includes phase shifters, wherein each phase shifter includes a plurality of PCB length routes that are selectable with a switch, wherein settings of the switch are determined by control signals. For at least some embodiments, all of a plurality of plated through hole vias of the PCB extend through the multilayer PCB from the first exterior layer to the second exterior layer, wherein vias that operate to connect control signals include extended cleanouts on layers of the multilayer PCB that do not include terminations of the control signals.

At least some embodiments further include enabling, by N metal patches, communication with a satellite, wherein the N metal patches are arranged in a square, wherein an air gap is located between the N metal patches and the N antenna elements, wherein dimensions, orientation, and spacing between the N metal patches and the N antenna elements are selected based on a carrier frequency, bandwidth, and directionality of the propagated RF signals.

As previously described, for at least some embodiments, the N antenna elements operate to enable formation of a pseudo-directional beam. As previously described, for at least some embodiments, the pseudo-directional beam is selectable to be directed to at least one of M possible directions as determined by the phase shifters of the RF chains, wherein the M possible directions cover a half spherical combination of beam directions, and wherein a spatial overlap between the pseudo-directional beam of the M possible directions are selected to provide maintenance of a wireless link between the apparatus and a base station through a satellite while the apparatus is subjected to motion having a slew rate of the motion of at least a threshold. As previously described, for at least some embodiments, the pseudo-directional beam is selected to include enough directional gain to enhance transmission from the apparatus through a wireless satellite link to a base station over a first carrier frequency, and wherein the pseudo-directional beam is selected to include enough omni-directional gain to support reception through a plurality of wireless satellite links over at least a second carrier frequency.

As previously described, for an embodiment, the N antenna elements that operate to form the M possible beams is associated with a processing unit and an IMU (internal measurement unit that includes, for example, an accelerometer, a gyroscope, and an optional magnetometer) and a GPS (global positioning system) receiver. For an embodiment, the IMU determines an absolute orientation of the antenna elements (or a device the antenna elements are attached to), and based upon the location of the radiating (transmitting) elements (for example, a user device antenna that includes the antenna elements) and receiving (for example, an uplink satellite) elements informs the processing unit how to control the switches to form/select the maximal gain/direction beam of the antenna elements. That is, the processing unit or controller associated with the antenna elements selects the operational beam formed (for example, a one of the M (9) possible beam directions) by the antenna elements based on the sensed orientation of the antenna elements, a location of the antenna elements, and a location of the satellite the antenna elements are facilitating wireless communication.

Further, as previously described, for an embodiment the antenna elements are associated with a processing unit and an RSSI (receive signal strength indicator) sensor, which the processing unit scans (via the control signals) through the 9 different beam configurations and selects the beam with the highest RSSI. For an embodiment, the best beam direction provides the greatest receive signal strength.

Figure 10:
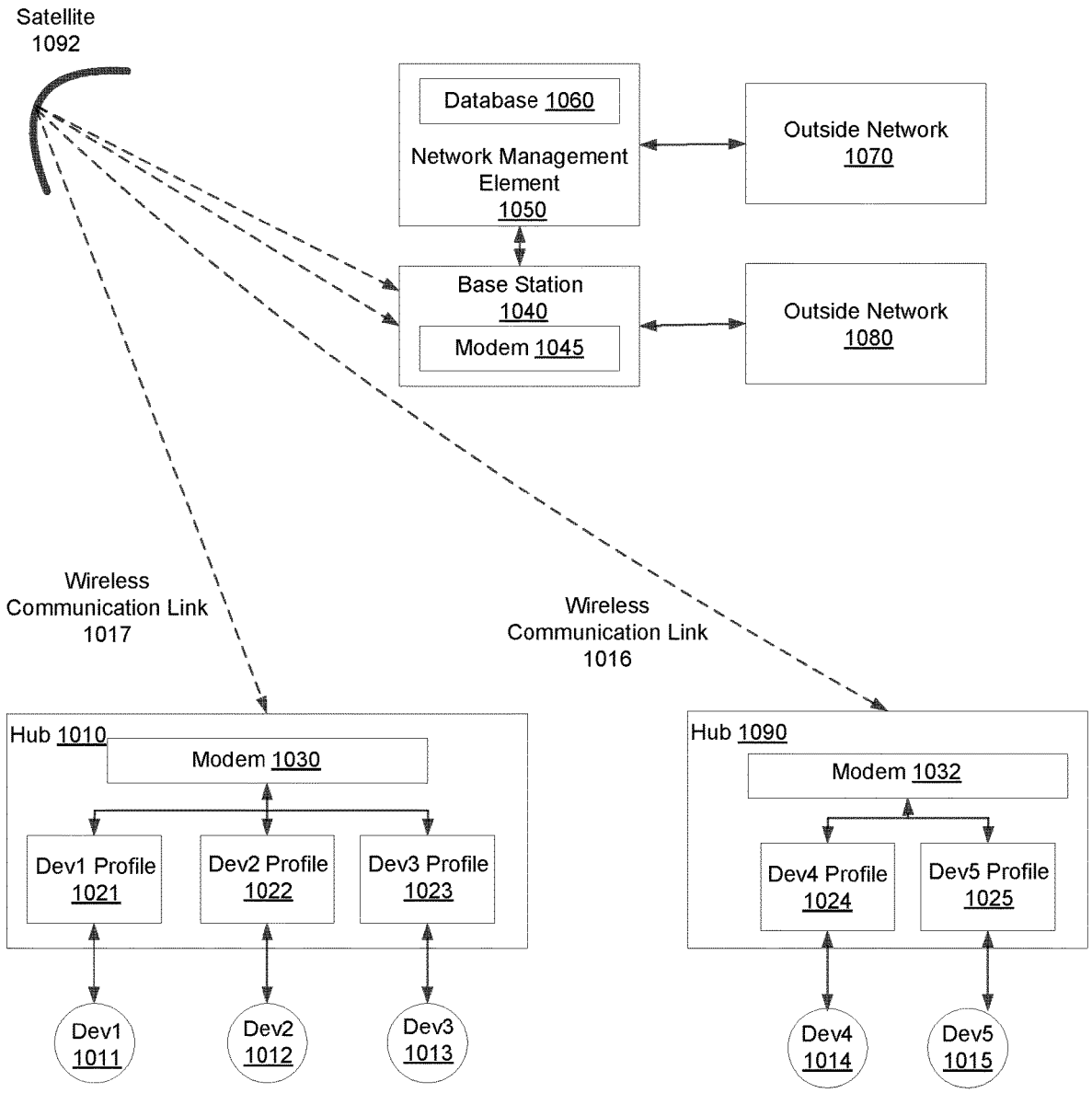
FIG. 10 shows a plurality of hubs that include modems that include the multiple layer printed circuit boards, according to an embodiment.

FIG. 10 shows a plurality of hubs 1010, 1090 that include modems that include the multiple layer printed circuit boards, according to an embodiment. For an embodiment, the plurality of hubs 1010, 1090 communicate data of data sources 1011, 1012, 1013, 1014, 1015 through satellite link(s) 1016, 1017 to a base station 1040. As shown, the data sources 1011, 1012, 1013, 1014, 1015 are connected to the hubs 1010, 1092. The hubs 1010, 1090 communicate through modems 1030, 1032 to a modem 1045 of the base station 1040 through the wireless satellite links 1016, 1017. The base station may also communicate with outside networks 1070, 1080. For an embodiment, the wireless satellite links 1016, 1017 reflectively pass through a satellite 1092.

It is to be understood that the data sources 1011, 1012, 1013, 1014, 1015 can vary in type, and can each require very different data reporting characteristics. The wireless satellite links 1016, 1017 links are a limited resource, and the use of this limited resource should be judicious and efficient. In order to efficiently utilize the wireless satellite links 1016, 1017, each of the data sources 1011, 1012, 1013, 1014, 1015 are provided with data profiles (shown as Dev profiles as a profile may be allocated for each device) 1021, 1022, 1023, 1024, 1025 that coordinate the timing (and/or frequency) of reporting (communication by the hubs 1010, 1090 to the base station 1040 through the wireless satellite links 1016, 1017) of the data provided by the data sources 1011, 1012, 1013, 1014, 1015.

For an embodiment, a network management element 1050 maintains a database 160 in which the data profiles 1021, 1022, 1023, 1024, 1025 can be stored and maintained. Further, the network management element 1015 manages the data profiles 1021, 1022, 1023, 1024, 1025, wherein the management includes ensuring that synchronization is maintained during the data reporting by the hubs 1010, 1090 of the data of each of the data sources 1011, 1012, 1013, 1014, 1015. That is, the data reported by each hub 1010, 1090 of the data of the data sources 1011, 1012, 1013, 1014, 1015 maintains synchronization of the data reporting of each of the data sources 1011, 1012, 1013, 1014, 1015 relative to each other. Again, the network management element 1050 ensures this synchronization through management of the data profiles 1021, 1022, 1023, 1024, 1025. The synchronization between the data sources 1011, 1012, 1013, 1014, 1015 distributes the timing of the reporting of the data of each of the data sources 1011, 1012, 1013, 1014, 1015 to prevent the reporting of one device from interfering with the reporting of another device, and provides for efficiency in the data reporting.

For at least some embodiments, the network management element 1050 resides in a central network location perhaps collocated with multiple base stations and/or co-located with a network operations center. For an embodiment, the network management element 1050 directly communicates with the base station 1040 and initiates the transfer of data profiles across the network via the base station 1040 to the hubs 1010, 1090.

For at least some embodiments, data profiles are distributed when new hubs are brought onto the network, when hubs change ownership, or when the hubs are re-provisioned. Other changes to data profile contents outside of these situations are more likely addressed by sync packets (for an embodiment, a sync packet is a packet to update the value of a specific field inside of a data profile, but not necessarily updating the structure of the data profile) where only small changes to profile fields are required.

As described, the data profiles 1021, 1022, 1023, 1024, 1025 control timing of when the hubs 1010, 1090 communicate the data of the data sources 1011, 1012, 1013, 1014, 1015 through wireless satellite links 1016, 1017 (shared resource). Accordingly, the described embodiments coordinate access to the shared network resource (wireless satellite links 1016, 1017) to insure optimal usage of the network resource to avoid collisions between packets, the transmission of redundant information, and to reshape undesired traffic profiles.

For at least some embodiments, the data profiles allow for the elimination of redundant data channel setup information which is already contained inside the data profile, which then are no longer needed to be shared upon the initiation of every packet sent across the network. This information may include the transmission size, sub-carrier (frequency) allocation, MCS (modulation and coding scheme) selection, and timing information. The result of this is a reduction in data resources consumed by the network to send a packet of data. In the example of sending a GPS data packet containing x, y, z, and time, the amount of redundant channel setup information is 8× larger than the actual GPS data packet of interest, resulting in a very inefficient network for large volumes of narrowband traffic. Additionally, in the realm of satellite communications, the elimination of unnecessary channel setup messages reduces the latency between the initiation of sending, for example, a GPS packet across the network and actually receiving that packet by roughly half. For example, a normally 3 second latency can be reduced to as low as 0.25 seconds.

While FIG. 10 shows each hub 1010, 1090 as including more than one data source, it is to be understood that each hub may include a single data source. Further, the data of a single data source may be treated differently based on the profile. That is, different data packets of the single data source may be reported, or communicated differently based on the profile of the data device. For example, some data of the data source may be reported or communicated periodically, whereas different data of the data source may be reported or communicated in real time. For an embodiment, characteristics or properties of the data determine or influence the timing of the communication of the data from the hub of the data source.

Further, while FIG. 10 shows the hubs and the data sources possibly being separate physical devices, it is to be understood that the hub and one or more data devices may actually be a single physical device.

Although specific embodiments have been described and illustrated, the embodiments are not to be limited to the specific forms or arrangements of parts so described and illustrated. The described embodiments are to only be limited by the claims.

What is claimed is:

1. An apparatus, comprising:

a first flat panel element, the first flat panel element comprising a multilayer PCB (printed circuit board), wherein the multilayer PCB includes more than two layers, the multilayer PCB comprising:

a first exterior layer comprising N antenna elements, wherein each of the N antenna elements operate to enable propagation of RF (radio frequency) signals; and a second exterior layer comprising N RF (radio frequency) chains operative to process the RF signals, each of the N RF chains electrically connected to a one of the N antenna elements, wherein each of the RF chains includes phase shifters; and N metal patches arranged in a square, wherein an air gap is located between the N metal patches and the N antenna elements, wherein dimensions, orientation, and spacing between the N metal patches and the N antenna elements are selected based on a carrier frequency, bandwidth, and directionality of the propagated RF signals.

2. The apparatus of claim 1, wherein the N antenna elements operate as radiating elements to enable the propagation of the RF signals.

3. The apparatus of claim 1, wherein the N metal patches operate as radiating elements, and a relative position between the N antenna elements and the N metal patches determines which radiating modes of the radiating elements are excited.

4. The apparatus of claim 1, further comprising:

a second flat panel element, the second flat panel element comprising the N metal patches, wherein an air gap is located between the first flat panel element and the second flat panel element, wherein dimensions, orientation, and spacing between the first flat panel element and the second flat panel element are selected based on a carrier frequency, bandwidth, and directionality of the propagated RF signals.

5. The apparatus of claim 1, further comprising:

an RF transparent cover, wherein the first flat panel element is enclosed within the RF transparent cover, and the RF transparent cover comprises N metal patches, wherein an air gap is located between the first flat panel element and the RF transparent cover, wherein dimensions, orientation, and spacing between the first flat panel element and the RF transparent cover are selected based on a carrier frequency, bandwidth, and directionality of the propagated RF signals.

6. The apparatus of claim 1, wherein the N antenna elements operate to enable formation of a pseudo-directional beam.

7. The apparatus of claim 6, wherein the pseudo-directional beam is selectable to be directed to at least one of M possible directions as determined by the phase shifters of the RF chains, wherein the M possible directions cover a half spherical combination of beam directions.

8. The apparatus of claim 7, wherein a spatial overlap between the pseudo-directional beam of the M possible directions are selected to provide maintenance of a wireless link between the apparatus and a base station through a satellite while the apparatus is subjected to motion having a slew rate of the motion of at least a threshold.

9. The apparatus of claim 7, wherein a subset of the M possible directions is activated at a time.

10. The apparatus of claim 6, wherein the pseudo-directional beam is selected to include enough directional gain to enhance wireless transmission from the apparatus through a wireless satellite link to a base station over a first carrier frequency.

11. The apparatus of claim 6, wherein the pseudo-directional beam is selected to include enough omni-directional gain to support wireless reception through a plurality of wireless satellite links over at least a second carrier frequency.

12. The apparatus of claim 6, wherein the omni-directional gain of the pseudo-directional beam is selected to be greater than a threshold for a plurality of directions corresponding to directions of satellites of one or more navigational systems.

13. The apparatus of claim 6, wherein the directional gain of the pseudo-directional beam is selected to be greater at a direction of a communication supporting a satellite link than for other directions.

14. The apparatus of claim 1, wherein the N antenna elements each include a pair of rectangular element patches, wherein a first element patch is rotated approximately 90 degrees relative to a second element patch, and wherein each of the pairs of rectangular element patches occupy a separate corner of the first exterior layer of the multilayer PCB.

15. A method, comprising:

enabling propagation, by N antenna elements of a first exterior layer of a multilayer PCB, RF (radio frequency) signals, wherein the multilayer PCB includes more than two layers; and processing, by N RF (radio frequency) chains of a second exterior layer of the multilayer PCB, the RF signals, wherein each of the N RF chains is electrically connected to a one of the N antenna elements, wherein each of the RF chains includes phase shifters; and:

enabling, by N metal patches, communication with a satellite, wherein the N metal patches are arranged in a square, wherein an air gap is located between the N metal patches and the N antenna elements, wherein dimensions, orientation, and spacing between the N metal patches and the N antenna elements are selected based on a carrier frequency, bandwidth, and directionality of the propagated RF signals.

16. The method of claim 15, wherein the N antenna elements operate to enable formation of a pseudo-directional beam.

17. The method of claim 16, wherein the pseudo-directional beam is selectable to be directed to at least one of M possible directions as determined by the phase shifters of the RF chains, wherein the M possible directions cover a half spherical combination of beam directions, and wherein a spatial overlap between the pseudo-directional beam of the M possible directions are selected to provide maintenance of a wireless link between the apparatus and a base station through a satellite while the apparatus is subjected to motion having a slew rate of the motion of at least a threshold.

18. The method of claim 16, wherein the pseudo-directional beam is selected to include enough directional gain to enhance transmission from the apparatus through a wireless satellite link to a base station over a first carrier frequency, and wherein the pseudo-directional beam is selected to include enough omni-directional gain to support reception through a plurality of wireless satellite links over at least a second carrier frequency.

19. The method of claim 15, wherein a second flat panel element comprises the N metal patches, wherein an air gap is located between the first flat panel element and the second flat panel element, wherein dimensions, orientation, and spacing between the first flat panel element and the second flat panel element are selected based on a carrier frequency, bandwidth, and directionality of the propagated RF signals.

20. The method of claim 15, wherein an RF transparent cover encloses the first flat panel element, and the RF transparent cover comprises N metal patches, wherein an air gap is located between the first flat panel element and the RF transparent cover, wherein dimensions, orientation, and spacing between the first flat panel element and the RF transparent cover are selected based on a carrier frequency, bandwidth, and directionality of the propagated RF signals.

* * * * *